United States Patent [19]

Exalto et al.

[11] 4,394,232

[45] Jul. 19, 1983

[54] PICKLING OF ALUMINUM

[75] Inventors: Robertus Exalto, Amsterdam; Adriaan Kwakernaak, Aalsmeer, both of Netherlands

[73] Assignee: Fokker B.V., Schiphol-Oost, Netherlands

[21] Appl. No.: 347,973

[22] Filed: Feb. 11, 1982

[30] Foreign Application Priority Data

Feb. 12, 1981 [NL] Netherlands ..... 8100686

[51] Int. Cl.[3] ..... C25F 1/04

[52] U.S. Cl. ..... 204/144

[58] Field of Search ..... 204/141.5, 144

[56] References Cited

U.S. PATENT DOCUMENTS 1,049,603 1/1913 Rosenberg ..... 204/144
4,042,475 8/1977 Bijlmer ..... 204/141.5
4,132,568 1/1979 Irwin .

FOREIGN PATENT DOCUMENTS 756039 8/1956 United Kingdom ..... 204/144

OTHER PUBLICATIONS

*Chemical Abstracts* Article, vol. 92, No. 16, Apr. 21, 1980.

*Primary Examiner*—T. M. Tufariello
*Attorney, Agent, or Firm*—Birch, Stewart, Kolasch & Birch

[57] ABSTRACT

Articles of aluminum are pickled by immersing them into a sulfuric acid bath containing no chromic acid or bichromate but having carbon particles suspended therein. The carbon particles will form tiny electric cells with the aluminum articles at their places of contact and will initiate electrochemical dissolution phenomena there at the point of contact.

7 Claims, 2 Drawing Figures

PICKLING OF ALUMINUM

BACKGROUND OF THE INVENTION

This invention relates in general to the art of pickling aluminum articles and more particular to a new process for pickling the same.

Articles of aluminum are often pickled at their surfaces in order to remove undesired oxide layers. This pickling operation may serve to obtain a more attractive appearance but also to give the pickled surface better characteristics for making adhesive joints or welded joints or to prepare it for an anodizing treatment.

The pickling operation is usually carried out by immersion of the article into an acid bath which comprises an oxidation agent in addition to a strong acid. Baths of chromic acid and sulfuric acid, as well as baths of sodium bichromate and sulfuric acid have been found to be most suitable for this purpose. However, although excellent results may be achieved in this way, the use of such pickling baths has become more and more objectionable in these days in view of the fact that the exhausted baths, due to their chromic acid or bichromate content, are most harmful to the environment and may, therefore, not be discharged to a sewer or to surface water in a direct way.

During a search for alternative pickling methods, it has been found that the same good results as in the past may be achieved with a pickling bath of sulfuric acid alone, provided that a slight anodic control voltage be applied to the bath. However, such anodic control voltage will complicate the method and will always cost energy. Therefore, it would be preferable if a method could be found wherein the control voltage is not needed.

The invention has for its object to provide a pickling process for aluminum articles wherein the use of chromic acid or bichromate in the pickling bath may be eliminated without any need for an anodic control voltage.

A further object is to provide a pickling process for aluminum articles wherein pickled articles of excellent quality can be obtained without the use of chromic acid or bichromate in the pickling bath and without any anodic control voltage.

In accordance with the present invention, these objects are realized by providing a pickling bath comprising carbon particles suspended in sulfuric acid without any chromic acid or bichromate being present. The carbon particles are preferably kept in suspension by agitating the bath continuously. Then, an aluminum article to be pickled is immersed into the bath and is maintained therein for a period of time sufficient to reach complete pickling of the article. As soon as the aluminium article has contacted one of the suspended carbon particles of the bath, a tiny electric cell having the aluminium article as an anode and the carbon particle as a cathode is formed. This cell will initiate an electrochemical dissolution phenomena at the surface of the aluminum article. Since a plurality of suspended carbon particles is present in the bath, many of these particles will contact the aluminum article and will form a corresponding number of tiny cells which will initiate the dissolution phenomena at the surface of the article. As a result thereof, the electrochemical dissolution phenomena is occurring at generally the entire immersed surface of the aluminum article and chemical attack the sulfuric acid of the bath is intensified, thereby, in an efficient way. When the aluminum article is maintained in the bath for a sufficient period of time, a complete pickling of the surface of the article may be achieved, in spite of the fact that the bath does not contain chromic acid or bichromate and in spite of the absence of an anodic control voltage.

In a copending patent application of even date entitled "Pickling Of Aluminum", there has been suggested positioning an aluminum article as an anode in a bath of sulfuric acid without chromic acid or bichromate, and then connecting this article by an external short-circuit connection to a carbon cathode placed in the same bath. In this case, proper pickling can be achieved as well, since a current will flow through the short-circuit connection and will initiate the electrochemical dissolution phenomena at the surface of the aluminum anode. Thus, chemical pickling by sulfuric acid is intensified by the electrochemical phenomena. The present invention differs from the copending case by the fact that a suspension of carbon particles instead of a carbon body is used and by the fact that the external short-circuit connection is not needed here.

Further characteristics of the invention process will be apparent from the following part of the specification.

According to the present invention, it is possible to obtain substantially equal results as with baths of chromic acid-sulfuric acid or bichromate-sulfuric acid. An important advantage is that chromic acid or bichromate are no longer required and this means that problems inherent to the disposal of exhausted baths are notably reduced. Another advantage is that an anodic control voltage is no longer required and this means that the apparatus may remain rather simple and that no energy supply is needed.

BRIEF DESCRIPTION OF THE DRAWINGS

The invention is illustrated by the accompanying drawings which are given only by way of example.

DESCRIPTION OF THE PREFERRED EMBODIMENT

Figure 1:
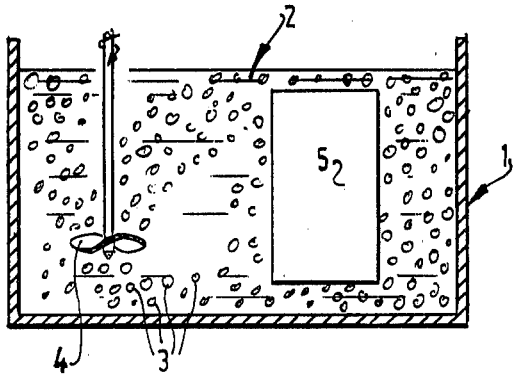
FIG. 1 shows schematically a preferred arrangement for carrying out the invention process.

A preferred embodiment for carrying out the invention process is shown in FIG. 1 of the drawings. This figure shows a pickling tank 1 containing a pickling bath 2 of sulfuric acid (without chromic acid or bichromate) having carbon particles 3 suspended therein. An agitator 4 and an aluminum article 5 to be pickled have been positioned in bath 2. The same parts can be discerned in the measuring arrangement of FIG. 2 but in that case, the aluminum article 5 is coupled through a circuit 6 including a voltmeter 7 with a saturated calomel electrode 8 for continuous measurement of the potential of the article.

Figure 2:
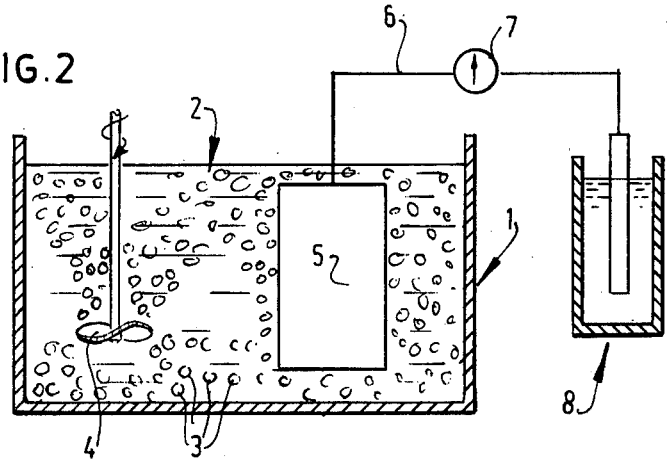
FIG. 2 shows a measuring arrangement.

In the measuring arrangement of FIG. 2, supposing that the aluminum article 5 has been immersed in the bath and that agitator 4 has been put into operation, the potential of the article 5 with regard to the bath 2 is measured continuously in order to determine the correct parameters for optimum operation. As soon as such parameters have been found, the arrangement of FIG. 1 is used for further operation and the values as found are used therein.

It should be noted that the process of the present invention and consequently the arrangements of FIGS.

1 and 2 are only meant for pickling of aluminum articles and not for an anodizing treatment thereof. Both pickling and anodizing treatments will result in the removal of an undesired oxide layer from the surface of the aluminum articles and in the formation of a new oxide layer on that surface, but a newly formed oxide layer after pickling has about the same thickness as the undesired initial oxide layer (about 400 Å) whereas a much thicker oxide layer (for instance of about 3 to 10 microns thickness) will result after a anodizing treatment due to the use of an external voltage.

The results of the pickling process may be expressed in various ways, e.g. by stating pickling rate and peel strength values. The pickling rate is an indication of the thickness of an oxide layer removed during the course of the pickling process and is expressed in $mg.dm^{-2}.h^{-1}$. The peel strength relates to a test wherein an adhesive layer is attached to the pickled surface and then peeled off. Both the pickling rate and the peel strength will in general have to exceed a certain minimum value in order to reach an economic pickling process or to reach a pickled product suitable for making adhesive joints, but the exact minimum value will depend upon practical requirements.

The results of the pickling process may also be expressed by stating microstructure quality of the aluminum surface. Such microstructure may be ascertained by electronmicroscopic inspection of direct carbon replicas taken directly from the aluminum surface. Generally speaking, a surface of aluminum is only suitable for making adhesive joints if the microstructure of the surface shows microscopic pits of about 300 Å in diameter. Should the pickling rate be too low, then residual oxide particles will still be present, and should the pickling rate be too high, then the etching pits will become too large.

Aluminum articles of any type may be pickled by the invention process. Articles of aluminum and aluminum alloys as well as articles of another metal coated with a layer of aluminum can be used. such articles may be of any shape, e.g. sheet or tubular shape. No problems will arise in the case of tubular shapes because all surfaces thereof, including the interior surface, will be well contacted by the carbon particle suspension and will effficiently be pickled thereby.

The carbon particles within the pickling bath may have been produced in any suitable way and may have any suitable size. It is preferred, however, that they form a suspension instead of an emulsion in the bath because proper contact between carbon and aluminum would be hard to reach with an emulsion. Further, it is preferred that the carbon particles be maintained a suspended state during the process so as to reach the ensure that the particles reach the entire surface of the aluminum article. To this end, the bath is preferably constantly agitated by agitator 4.

In addition to the carbon particles, bath 2 may in principle only comprise sulfuric acid although many additives may be present in order to promote the electrochemical phenomena. The sulfuric acid concentration in the bath may vary between wide limits but concentrations of 100 to 300 $g/dm^3$ of $H_2SO_4$ are preferred in most cases. Further, the bath will mostly be at an elevated temperature, e.g. between 60° and 75° C.

When the aluminum article is placed into the bath and the agitator is started, the electrochemical potential in the bath should have a sufficient value to cause the passage of an electric current through the bath. Quite generally, this value will be sufficient when an aluminum article and the carbon particles are used, but the actual value of this potential will depend from several facts such as the carbon particle content of the bath, the temperature and sulfuric acid concentration of the bath, the agitating speed, the nature of the aluminum article and the like.

The most important fact is the carbon particle content within the bath since a sufficient number of carbon particles must be present in order to contact the aluminum article and to form tiny electric cells at its surface. Quite generally, it may be stated that at least 200 $gram/dm^3$ of carbon particles must be present in the bath in order to reach a sufficiently high value of the electrochemical potential, i.e. more than 200 mV with regard to the saturated calomel reference electrode. Agitation starts to become difficult at concentrations above 300 $g/dm^3$ and an upper limit in practice is formed by a concentration of 350 $g/dm^3$.

The temperature and sulfuric acid concentration of the bath will also have a certain influence on the electrochemical potential and may be selected at will within a range of between 40° and 75° C. and between 100 and 300 $g/dm^3$ respectively. The temperature and sulfuric acid concentration need not be kept at low values because there is no danger of the polarization phenomena occurring in the process of the present invention.

The nature of the aluminum article has only a small influence on the pickling process in most cases, although an article having a homogeneous surface (e.g. with an electrolytically deposited aluminum coating) will show somewhat more resistance to pickling (a smaller pickling rate) than an article having a non-homogeneous surface such as an aluminum alloy without any coating.

In cases wherein the pickling process has been used several times in succession for pickling articles of a copper-containing aluminum alloy, there may be a risk of a copper deposit onto the aluminum article. This risk may be removed, however, by maintaining the electrochemical potential at a value higher than 200 mV with regard to the saturated calomel reference electrode.

The time period of the pickling process should be sufficient to obtain proper pickling and will, in general, be between 10 and 30 minutes.

During tests with aluminum articles of various types (2024-T3 and 2024-T3 clad) it appeared that optimum pickling, with regard to the microstructure of the surface and the peel strength, could be achieved by using the following combination of conditions:

| | |
|---|---|
| $H_2SO_4$ concentration in bath | 200 $g/dm^3$ |
| carbon concentration | 250 $g/dm^3$ |
| bath temperature | 40 or 50 or 60° C. |
| agitating speed | 1100 or 1500 or 1900 rpm |
| pickling time | 30 min. |

At these optimum pickling conditions, the pickling rate was still relatively small and at least smaller than with prior art pickling in chromic-sulfuric acid. However, the pickling rate can be increased by effected the pickling process at higher temperatures.

Regarding the agitating speed, it should be noted that its optimum value will depend upon the number of causing the agitation. In any case, however, the agitating speed should be sufficient to keep the carbon particles in suspension.

The carbon-containing sulfuric acid bath may be used several times in succession for pickling aluminum articles. In principle, the bath will not need an additional supply of the main constituents because no sulfuric acid or carbon is used during the pickling process. Nevertheless, some aluminum from the articles being pickled will always dissolve into the bath and this means that the dissolved aluminum should be removed from the bath from time to time.

The invention being thus described, it will be obvious that the same maybe varied in many ways. Such variations are not to be regarded as a departure from the spirit and scope of the present invention, and all such modifications as would be obvious to one skilled in the art are intended to be included within the scope of the following claims.

What we claim is:

1. A pickling process for aluminum articles, comprising the steps of:

(a) providing a pickling bath consisting essentially of a suspension of carbon particles in sulfuric acid, (b) immersing an aluminum article to be pickled into said bath, and (c) maintaining said article in said bath for a period of time sufficient to effect complete pickling of said article.

2. The process as claimed in claim 1, wherein said bath is continuously agitated to keep said carbon particles in a suspended state.

3. The process as claimed in claim 1, wherein said bath comprises at least about 200 g/dm$^3$ of carbon particles.

4. The process as claimed in claim 1, wherein said bath has is maintained at a temperature of between 40° and 75° C. at a sulfuric acid concentration of between 100 and 300 g/dm$^3$ in said bath.

5. A pickling process for aluminum articles, comprising the following steps:

(a) providing a pickling bath consisting essentially of a suspension of carbon particles in sulfuric acid, (b) agitating said bath continuously to keep said carbon particles in a suspended state, (c) immersing an aluminum article to be pickled into said bath, and (d) maintaining said article immersed for a period of time sufficient to effect complete pickling of said article.

6. The process as claimed in claim 5, wherein said bath comprises at least about 200 g/dm$^3$ of carbon particles.

7. The process as claimed in claim 5, wherein said bath has a temperature of between 40° and 75° C. at a sulfuric acid concentration of between 100 and 300 g/dm$^3$ in said bath.

* * * * *